US005356231A

United States Patent [19]

Nakamura et al.

[11] Patent Number: 5,356,231

[45] Date of Patent: Oct. 18, 1994

[54] INK JET PRINTER

[75] Inventors: Shinya Nakamura; Yoshiaki Tanaka, both of Shizuoka, Japan

[73] Assignee: Tokyo Electric Co., Ltd., Tokyo, Japan

[21] Appl. No.: 93,853

[22] Filed: Jul. 20, 1993

[30] Foreign Application Priority Data

Jul. 20, 1992 [JP] Japan ..... 4-192066

[51] Int. Cl.[5] ..... B41J 13/00

[52] U.S. Cl. ..... 400/636; 400/634; 400/624; 400/625

[58] Field of Search ..... 271/272-274; 400/636, 634, 624, 625, 636.1, 636.2, 636.3; 346/136

[56] References Cited

U.S. PATENT DOCUMENTS 4,468,713 8/1984 Osanai ..... 360/130.21
4,708,504 11/1987 Asakura ..... 400/637
4,725,861 2/1988 Oda ..... 346/140 R
4,997,179 3/1991 Mizutani et al. ..... 271/306
5,168,291 12/1992 Hiramatsu et al. ..... 346/140 R
5,192,141 3/1993 Chung et al. ..... 400/56

FOREIGN PATENT DOCUMENTS 3534118 4/1987 Fed. Rep. of Germany ..... 400/636
405104798 4/1993 Japan ..... 400/636

*Primary Examiner*—Edgar S. Burr
*Assistant Examiner*—Lynn D. Hendrickson
*Attorney, Agent, or Firm*—Oblon, Spivak, McClelland, Maier & Neustadt

[57] ABSTRACT

The present invention provides an ink jet printer wherein a pinch roller is contacted with a printed face of paper after printing by an ink jet head to press the paper against a paper discharging roller, which contacts with a non-printed face of the paper after printing by the ink jet head to feed the paper to a paper discharging station, and a cut portion for exposing part of an outer circumferential face of the pinch roller is formed in a pinch roller cover which covers over the pinch roller so that a paper discharging operation for the printed paper is made smooth and cleaning of the pinch roller when ink of the printed paper sticks to the pinch roller can be performed readily with safety.

10 Claims, 4 Drawing Sheets

INK JET PRINTER

BACKGROUND OF THE INVENTION

1. Field of the Invention

This invention relates to an ink jet printer wherein ink drops are applied to paper to effect desired printing.

2. Description of the Related Art

A general construction of an ink jet printer is shown as the related art in FIG. 4. A substantially U-shaped paper path 101 is formed so as to extend from a paper supplying station A to a paper discharging station B, and an ink jet head 102 is disposed in a printing station C intermediately of the paper path 101. The ink jet head 102 is moved in a direction perpendicular to the plane of FIG. 4 by a carrier not shown and jets drops of ink to paper to effect desired printing.

A feed roller 103 is disposed intermediately of the paper path 101. The feed roller 103 cooperates with a leaf plate 104 to feed cassette paper from a paper tray 106 positioned in the paper supplying station A or paper manually inserted into the paper path 101 to the printing station C. More particularly, the feed roller 103 rotates in the direction indicated by an arrow mark in FIG. 4 to transport paper pressed against it by the leaf plate 104 to the printing station C.

A paper discharging apparatus 110A is disposed at the last end of the paper path 101. The paper discharging apparatus 110A is provided to discharge paper (printed paper) after printing by the ink jet head 102 and includes a paper discharging roller 111 for transporting printed paper in a paper discharging direction (the direction indicated by an arrow mark E in FIG. 4), and a pinch roller 112 for resiliently pressing printed paper against the paper discharging roller 111. More particularly, the paper discharging roller 111 is mounted for rotation in the direction indicated by an arrow mark in FIG. 4 on the downstream side with respect to the ink jet head 102 in the paper transporting direction. The pinch roller 112 is mounted for resiliently pressing printed paper against the paper discharging roller 111 making use of the force of a spring or a like element. In order to prevent transfer of ink from printed paper to the pinch roller 112, the pinch roller 112 is formed as a pinch roller having a serrated outer circumferential face which has a smaller contacting area with printed paper. The pinch roller 112 is mounted for rotation on a pinch roller holder 113 by means of a support shaft 112*a* and is normally resiliently pressed against the paper discharging roller 111 by a spring 114.

In the ink jet printer of the structure described above, when the feed roller 103 rotates, paper held on the paper tray 106 is supplied into the paper path 101, and desired printing of the paper is performed by the ink jet head 102 in the printing station C. Then, the paper after printing is fed in the paper discharging direction (the direction of the arrow mark E in FIG. 4) by cooperation between the paper discharging roller 111 and the pinch roller 112 and is discharged into a paper receiving section 119 with the printed face thereof directed upwardly.

Several problems of the related art described above will be described subsequently. In the ink jet printer described above, in order to prevent soiling to paper which arises from transfer of ink to the outer circumferential face of the pinch roller 112, an ink absorbing member such as, for example, a blotter roller 129 for contacting with the outer circumferential face of the pinch roller 112 to absorb ink is sometimes provided as indicated by an alternate long and two short dashes line in FIG. 4. Normally, the blotter roller 129 is mounted for rotation on the pinch roller holder 113 by means of a support shaft 129*a*. The blotter roller 129, however, cannot completely prevent sticking of ink to the circumferential face of the pinch roller 112. Therefore, the circumferential face of the pinch roller 112 must necessarily be cleaned periodically.

Further, the blotter roller 129 is held in pressing contact under considerably strong force with the pinch roller 112 taking an error in working, an error in assembly and so forth into consideration. Consequently, the related art ink jet printer has a drawback that such a high rotational load may be applied to the pinch roller 112 that the pinch roller 112 may not rotate sufficiently upon feeding of paper, resulting in failure to smoothly discharge printed paper.

It is to be noted that, while development of the technique for preventing ink from sticking to the outer circumferential face of the pinch roller 112, such as, for example, a coating of the pinch roller 112 with a water repellent material to which ink does not stick readily such as, for example, a material of the TEFLON, has been and is being proceeded recently, it is impossible to completely prevent sticking of ink to the outer circumferential face of the pinch roller 112.

SUMMARY OF THE INVENTION

It is an object of the present invention to provide an ink jet printer which can discharge paper with certainty by means of a paper discharging roller and a pinch roller.

It is another object of the present invention to provide an ink jet printer wherein, when necessary, a pinch roller can be cleaned readily with safety.

In accordance with the present invention, a paper path for guiding paper along a predetermined route from a paper supplying station to a paper discharging station is formed, and an ink jet head for printing the paper guided along the paper path and a paper discharging roller for contacting with a non-printed face of the paper after printing to feed the paper to the paper discharging station are disposed along the paper path. A pinch roller is contacted with a printed face of the paper after printing to press the paper against the paper discharging roller, and a pinch roller cover for covering over the pinch roller has a cut portion formed therein for exposing part of the outer circumferential face of the pinch roller. With the ink jet printer of the construction, paper can be discharged with certainty by means of the paper discharging roller and the pinch roller, and when ink of printed paper sticks to the pinch roller, cleaning of the pinch roller can be performed readily with safety.

DETAILED DESCRIPTION OF THE PREFERRED EMBODIMENT

Figure 1:
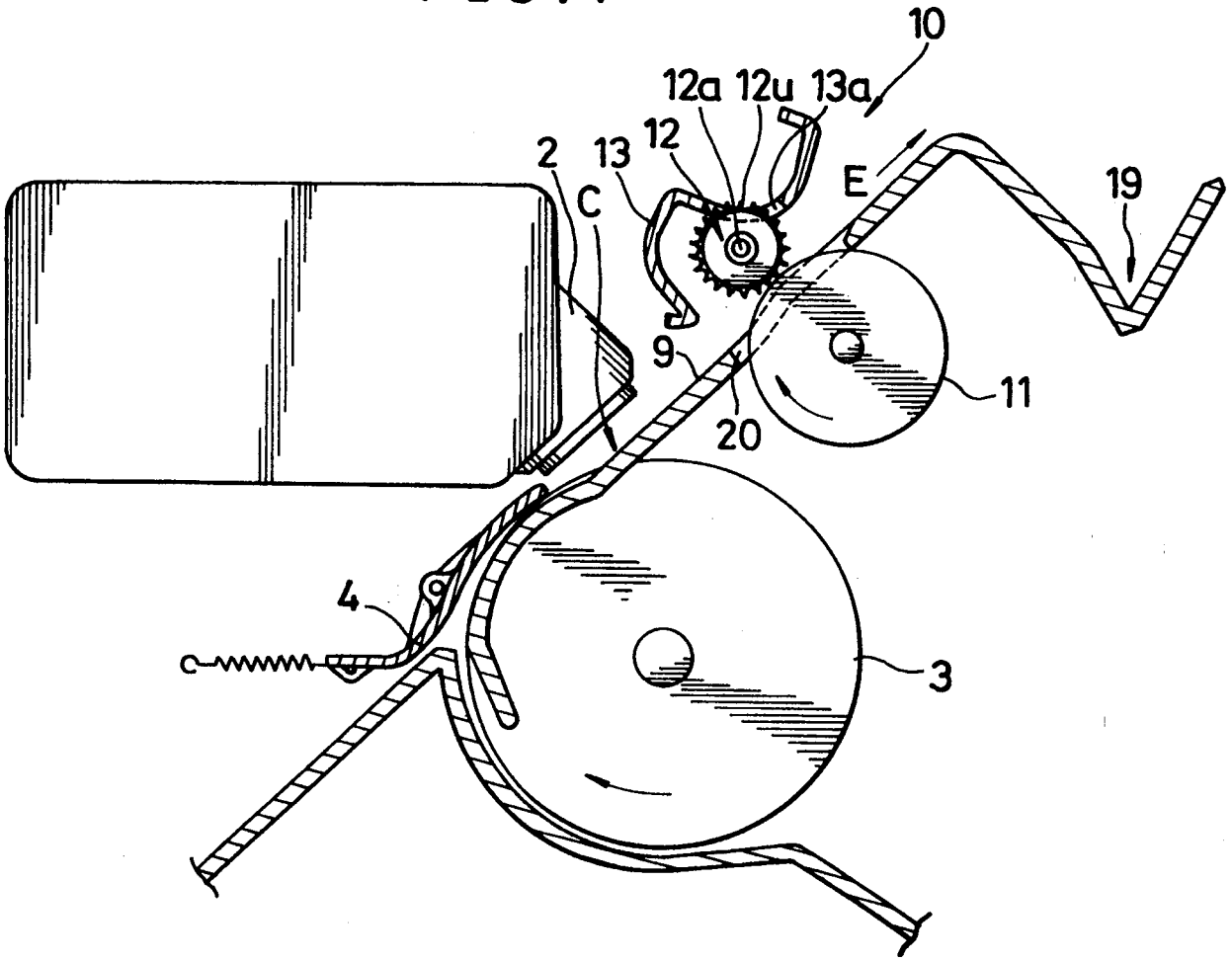
FIG. 1 is a vertical sectional side elevational view of an ink jet printer showing a preferred embodiment of the present invention with a paper supplying station omitted.
Figure 2:
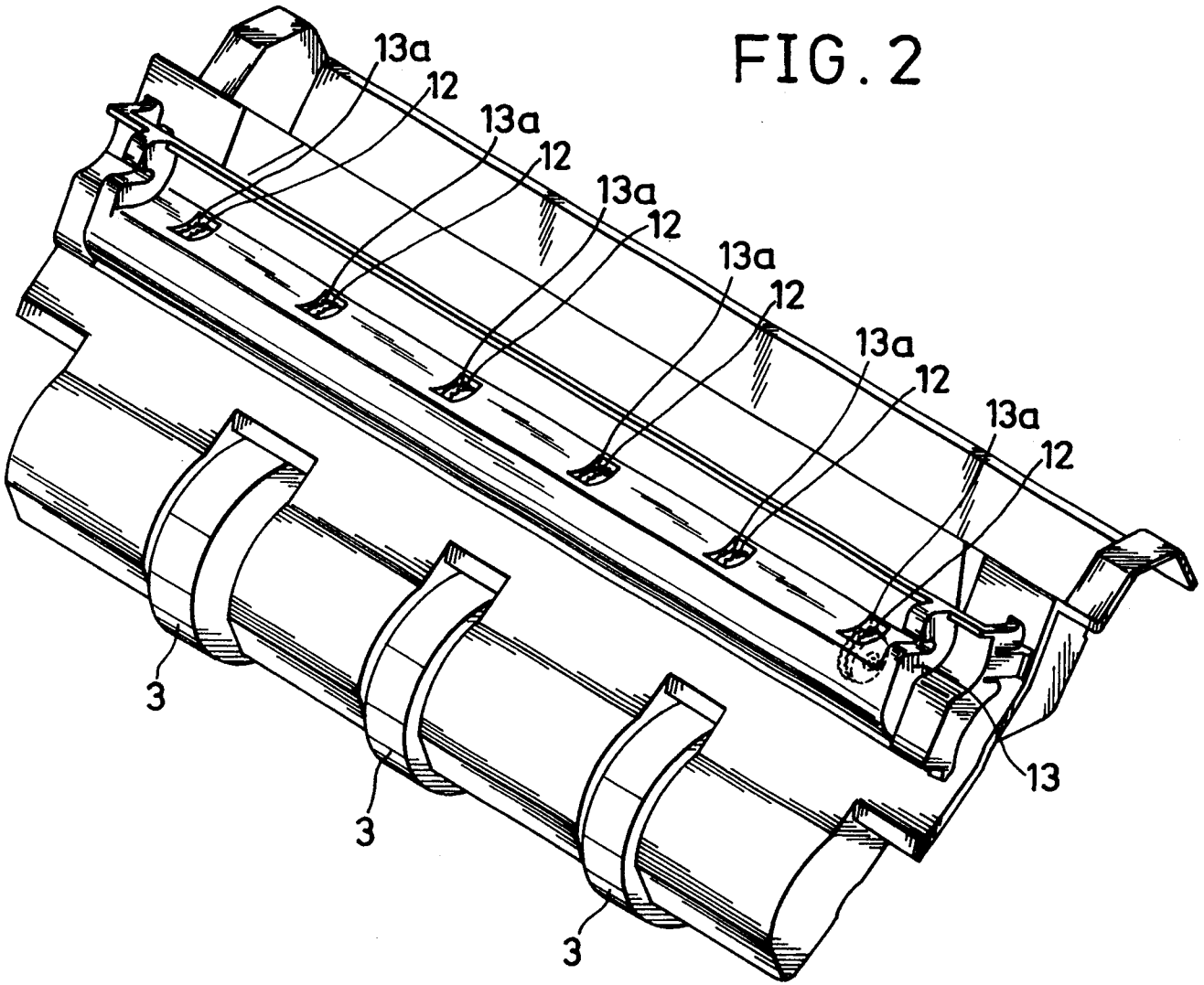
FIG. 2 is a perspective view of the ink jet printer illustrating the positional relationship between a pinch roller and a cut hole of a pinch roller cover.
Figure 3:
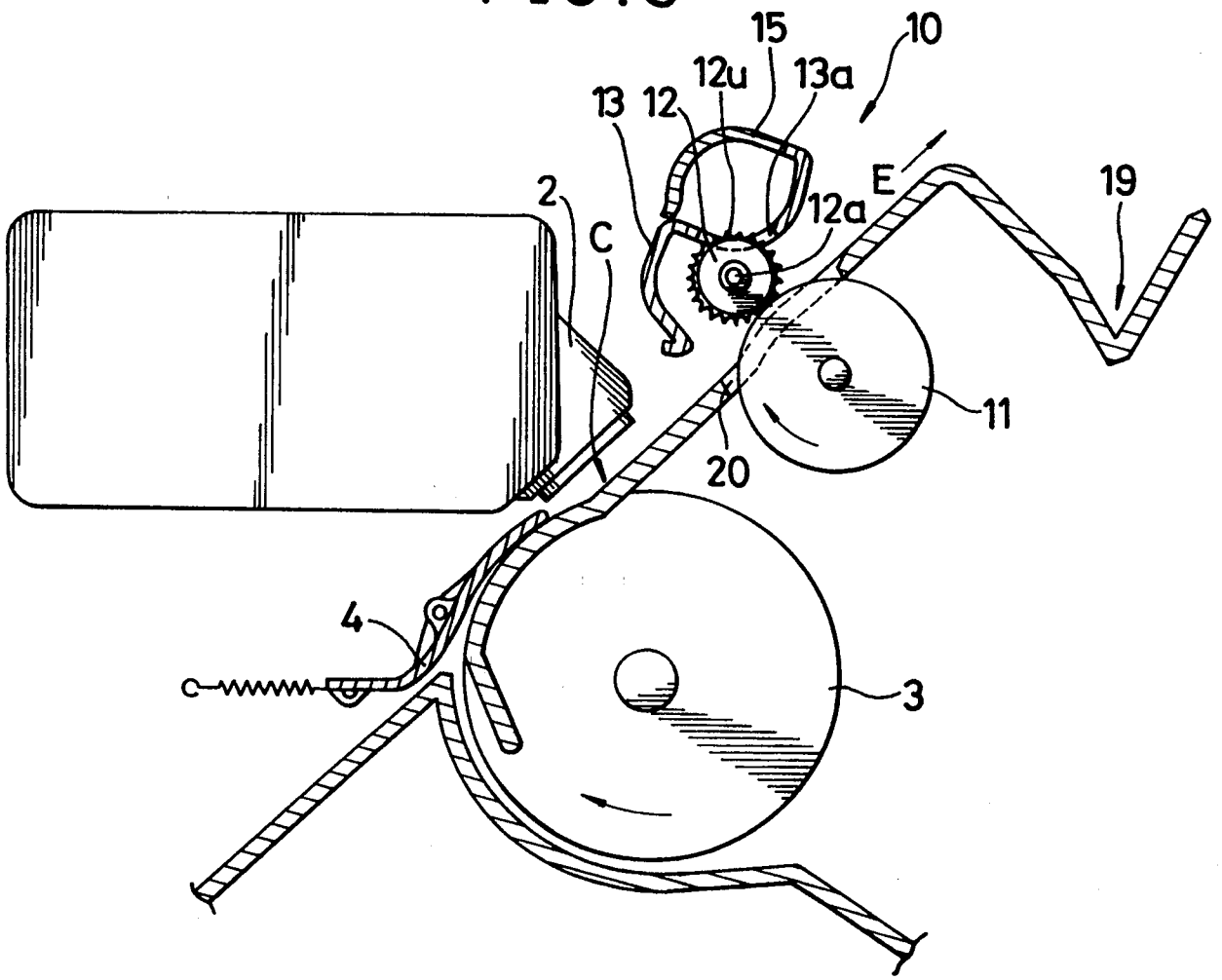
FIG. 3 is a vertical sectional side elevational view of a modification to the ink jet printer of FIG. 1 showing a manner wherein a protective cover is mounted on a pinch roller cover with a paper supplying station omitted.
Figure 4:
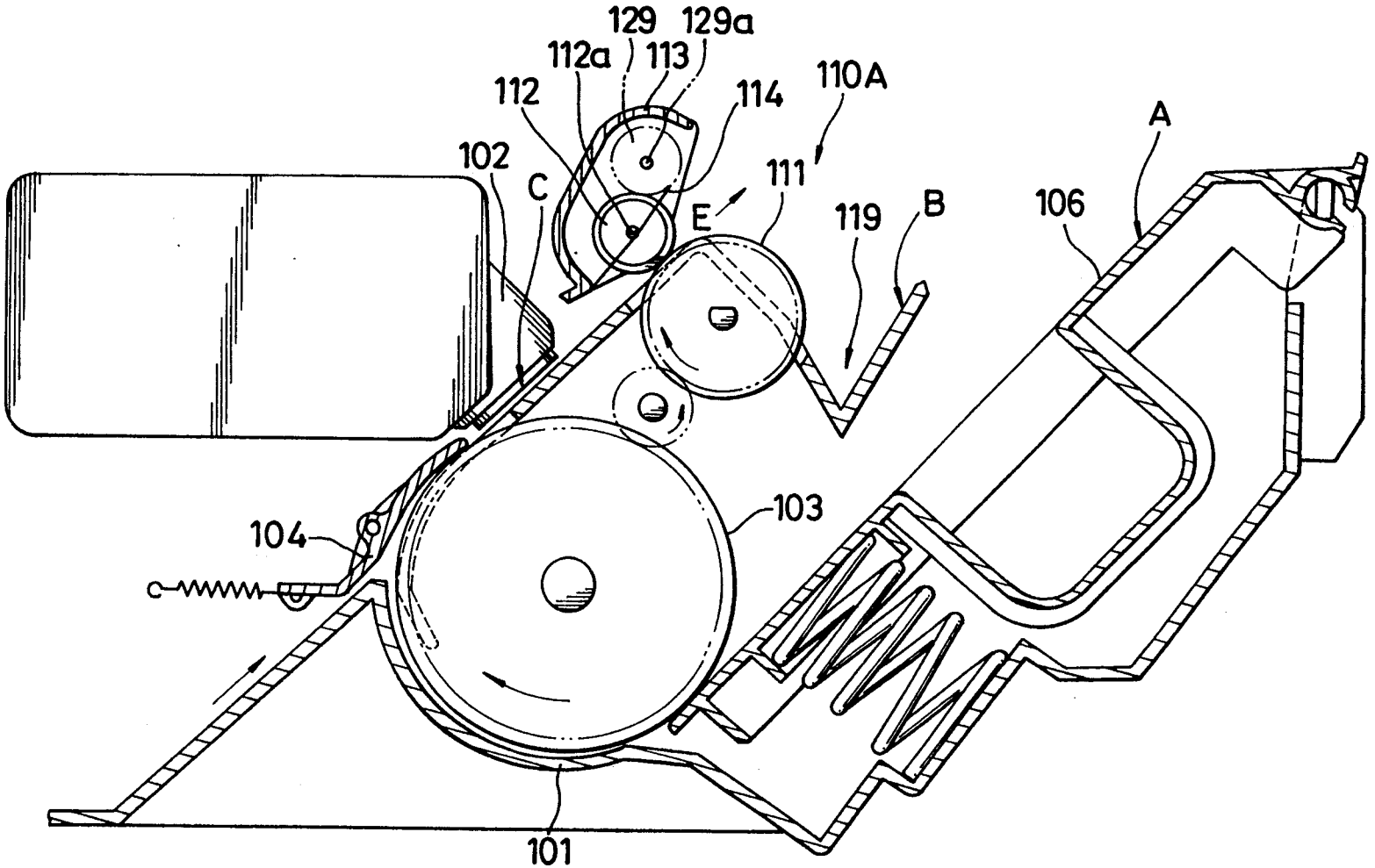
FIG. 4 is a vertical sectional side elevational view showing a general construction of a conventional ink jet printer.

A preferred embodiment of the present invention will be described below with reference to FIGS. 1 to 3. The ink jet printer of the present embodiment includes, as shown in FIGS. 1 to 3, a feed roller 3, an ink jet head 2 and a paper discharging apparatus 10 including a paper discharging roller 11 and a pinch roller 12, and some other elements disposed in this order along a paper path 1. The paper path 1 is formed from a paper guide 9 in the form of a plate and some other elements so as to extend from a paper supplying station A to a paper discharging station B past a printing station C and have a substantially U-shape in side elevation. A paper tray not shown is disposed in the paper supplying station A, and the ink jet head 2 is disposed in the printing station C while a discharged paper receiving section 19 is disposed in the paper discharging station B. The feed roller 3 is disposed at the position of a bend of the substantially U-shaped paper path 1 and is driven by a driving section not shown to rotate to supply paper sheets held in an accumulated condition in the paper tray one by one into the paper path 1 and cooperate with a leaf plate 4 to feed the paper sheet into the printing station C. Further, the ink jet head 2 is moved in a direction perpendicular to the plane of FIG. 1 by a carrier not shown and jets drops of ink to effect desired printing. The paper discharging apparatus 10 is disposed immediately before the discharged paper receiving section 19 along the paper path 1. The paper discharging roller 11, which is a component of the paper discharging apparatus 10, is disposed at a position in which an outer circumferential face thereof projects into the paper path 1 through a cut hole 20 for a paper discharging roller formed in the paper guide 9.

Here, the pinch roller 12 is disposed at a location higher than the printing station C and contacts with a printed-face of paper after printing by the printing station C to resiliently press the paper against the paper discharging roller 11 and cooperate with the paper discharging roller 11 to transport the paper in a paper discharging direction (the direction indicated by an arrow mark in FIG. 1). The pinch roller 12 is divided into six divisional pieces and mounted for rotation on the pinch roller holder 13, which serves as a pinch roller cover, by means of a support shaft 12*a*. The divisional pinch rollers 12 are coated with a water repellent material of the Teflon type, to which ink does not stick readily, and have serrated outer circumferential faces. Accordingly, ink does not stick to the outer circumferential faces of the pinch rollers 12 readily. Further, the pinch rollers 12 are colored white so that the degree of soiling to them can be discerned readily. The color is not limited to white, and any color may be employed only if the reflection factor of light is high.

The pinch roller holder 13 has cut holes 13*a* formed as cut portions at locations thereof opposing to and spaced from the paper discharging roller 11 and covers over the pinch rollers 12 so that upper circumferential face portions 12*u* of the pinch rollers 12 may project through the cut holes 13*a*. The pinch roller holder 13 is open at the bottom thereof which opposes to the paper discharging roller 11. The pinch roller holder 13 further has a valley-shaped portion and has the cut holes 13*a* formed at a bottom portion of the valley shape.

In the ink jet printer of the construction described above, when the feed roller 3 rotates, a paper sheet held in the paper tray is sent out into the paper path 1, and the thus sent out paper is fed into the printing station C, in which desired printing on the paper is performed by the ink jet head 2. Then, the thus printed paper is fed in the paper discharging direction (the direction indicated by an arrow mark E in FIG. 1) by cooperation between the paper discharging roller 11 and the pinch roller 12 and is discharged into the paper receiving section 19 with the printing face thereof directed upwardly. In this instance, since a rotation resisting element such as a blotter roller is not pressed against the pinch roller 12, no excessively high rotational load acts upon the pinch roller 12. Consequently, the printed paper can be discharged smoothly by means of the pinch roller 12 and the paper discharging roller 11.

Further, when necessary, the upper circumferential face portions 12*u* of the pinch rollers 12 which project through the cut holes 13*a* of the pinch roller holder 13 can be cleaned while the pinch rollers 12 are rotated suitably. In this instance, since only the upper circumferential face portions 12*u* of the pinch rollers 12 are exposed, the cleaning operation of the pinch rollers 12 can be performed with safety. Further, since the cut holes 13*a* of the pinch roller holder 13 are formed at the locations opposing to and spaced from the paper discharging roller 11, also the upper circumferential face portions 12*u* of the pinch rollers 12 are positioned in a spaced relationship from the paper discharging roller 11, and consequently such an accident that a member to be used for cleaning is caught between the paper discharging roller 11 and the pinch rollers 12 is prevented and the safety of the cleaning operation is ensured. Further, since the pinch roller holder 13 has a valley shape around the cut holes 13*a*, the hand can be stretched to the pinch roller 12 readily without increasing the exposure area of the outer circumferential faces of the pinch rollers 12, and accordingly, the cleaning operation of the pinch rollers 12 is facilitated. Also the disposition of the pinch rollers 12 at the location higher than the printing station C contributes to the fact that the hand can be stretched to the pinch roller 12, and the facilitation of the cleaning operation is achieved also by the disposition. Further, since the pinch roller 12 is divided into six divisional pieces and the outer circumferential faces of the divisional pinch rollers 12 are formed as serrated faces, the contact areas of the pinch rollers 12 with the printed face of the printed paper are reduced, and accordingly, also the area which necessitate cleaning is reduced. In addition, since the outer circumferential faces of the pinch rollers 12 are coated with a water repellent material, ink does not stick readily to the outer circumferential faces of the pinch rollers 12, and when ink sticks to the outer circumferential faces of the pinch rollers 12 to such a degree that they require cleaning, this can be found out and determined readily since the outer circumferential faces of the pinch rollers 12 are white.

Since the pinch roller holder 13 is provided in such a manner as to cover over the pinch rollers 12 so that the upper circumferential face portions 12*u* of the pinch rollers 12 project through the cut holes 13*a*, when necessary, the pinch rollers 12 can be cleaned readily with safety while assuring a smooth paper discharging operation by means of the paper discharging roller 11 and the pinch rollers 12. Further, since the pinch roller holder 13 serves also as a member for holding the pinch rollers 12 for rotation thereon, the number of parts is not increased and reduction of the cost can be achieved readily.

It is to be noted that a modification to the ink jet printer described above is shown in FIG. 3. The modified ink jet printer is modified in structure in that a protective cover 15 for covering over the cut holes 13*a* is removably provided on the pinch roller holder 13. With the ink jet printer of the structure, admission of dust, paper fluff and so forth into the pinch roller holder 13 can be prevented further effectively.

What is claimed is:

1. An ink jet printer which applies drops of ink to paper to effect desired printing, comprising:

a mechanism for defining a paper path for guiding paper along a predetermined route from a paper supplying station to a paper discharging station;

an ink jet head for printing the paper guided along said paper path;

a paper discharging roller for contacting with a non-printed face of the paper after printing by said ink jet head to feed the paper to said paper discharging station;

a pinch roller having a serrated outer circumferential face for contacting with a printed face of the paper after printing by said ink jet head to press the paper against said paper discharging roller; and a pinch roller cover for covering over said pinch roller, part of the outer circumferential face of said pinch roller projecting from said cover to contact said paper, said cover having a cut portion formed therein for exposing another part of said outer circumferential face of said pinch roller at a location where said pinch roller does not contact said paper.

2. An ink jet printer as claimed in claim 1, wherein said cut portion of said pinch roller cover is formed at a location thereof spaced from said paper discharging paper.

3. An ink jet printer as claimed in claim 1, wherein said pinch roller cover has a valley-shaped portion having said cut portion at a bottom portion thereof.

4. An ink jet printer as claimed in claim 1, further comprising a protective cover for covering over said cut portion of said pinch roller cover for opening and closing operation.

5. An ink jet printer as claimed in claim 1, wherein said pinch roller is divided into a plurality of pieces.

6. An ink jet printer as claimed in claim 1, wherein said outer circumferential face of said pinch roller has a water repellent property.

7. An ink jet printer as claimed in claim 6, wherein said outer circumferential face of said pinch roller is provided with the water repellent property by a coating of a water repellent material.

8. An ink jet printer as claimed in claim 1, wherein said outer circumferential face of said pinch roller has a color having a high light reflection factor.

9. An ink jet printer as claimed in claim 8, wherein said outer circumferential face of said pinch roller is white.

10. An ink jet printer as claimed in claim 1, wherein said pinch roller is disposed at a location higher than said ink jet head.

* * * * *